United States Patent [19]

Schweizer et al.

[11] 4,189,163

[45] Feb. 19, 1980

[54] ANTI-CROSSOVER DEVICE FOR SKIS

[75] Inventors: Gottfried Schweizer; Axel Kubelka; Karl Stritzl, all of Vienna; Josef Svoboda, Schwechat, all of Austria

[73] Assignee: TMC Corporation, Baar, Switzerland

[21] Appl. No.: 705,268

[22] Filed: Jul. 14, 1976

[30] Foreign Application Priority Data

Jul. 18, 1975 [AT] Austria ..... 5599/75

[51] Int. Cl.[2] ..... A63C 11/00

[52] U.S. Cl. ..... 280/11.37 E

[58] Field of Search ..... 280/11.37 E, 605, 601, 280/604

[56] References Cited

U.S. PATENT DOCUMENTS

| | | | |
|---|---|---|---|
| 2,159,130 | 5/1939 | Burgett | 280/605 |
| 3,083,028 | 3/1963 | Miller | 280/605 |
| 3,940,158 | 2/1976 | Wehrli | 280/605 |
| 3,964,760 | 6/1976 | Riedel | 280/605 |
| 3,989,271 | 11/1976 | Riedel | 280/605 |

FOREIGN PATENT DOCUMENTS

| | | | |
|---|---|---|---|
| 638773 | 3/1962 | Canada | 280/605 |
| 137772 | 1/1930 | Switzerland | 280/605 |

*Primary Examiner*—David M. Mitchell

*Attorney, Agent, or Firm*—Blanchard, Flynn, Thiel, Boutell & Tanis

[57] ABSTRACT

A structure for a use in either an anti-crossing device for skis or a ski brake. A torsion spring is utilized to urge a projection member to an upright position on the ski. In the anti-crossing device for skis, the resilient projection member will prevent movement of a ski to the crossed position in one direction while simultaneously permitting movement of the ski in the opposite direction by flexing the resilient projection downwardly onto the upper surface of the ski. In the ski brake environment, the ski boot effects a resilient flexing of the projection member down onto the upper surface of the ski when the ski boot is mounted between the ski bindings. The resilient projection member has extension members which project below the lower surface of the ski when the resilient projection member is in the upright position.

2 Claims, 13 Drawing Figures

FIG. 1
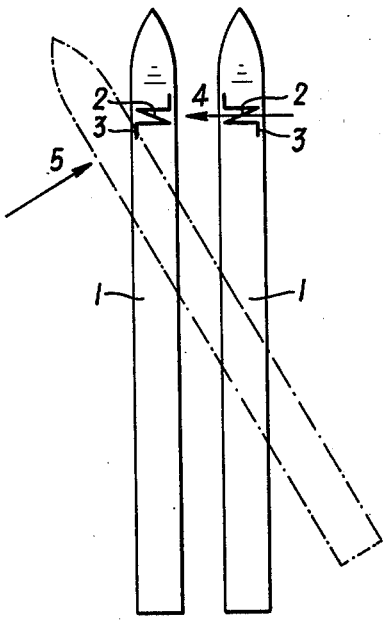
FIG. 2
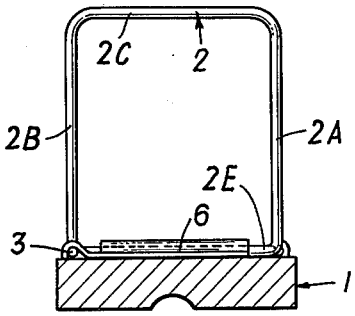
FIG. 3
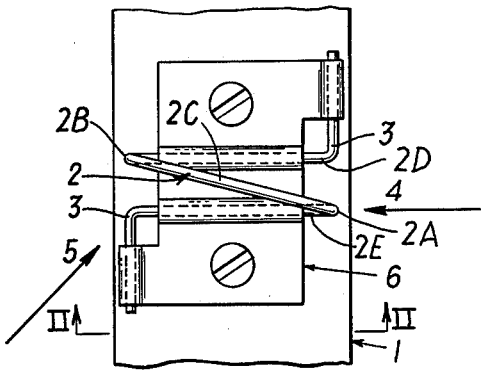
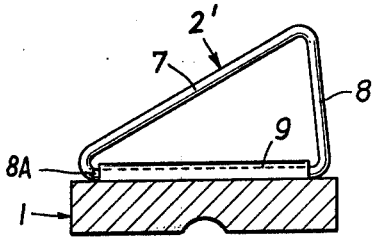
FIG. 4
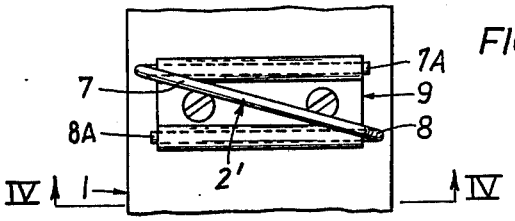
FIG. 5

ANTI-CROSSOVER DEVICE FOR SKIS

FIELD OF THE INVENTION

The invention relates to a device for skis which includes a rod which can be swung on the ski against the force of a spring.

BACKGROUND OF THE INVENTION

Devices are known which are mounted on the ski and project upwardly during use. This is supposed to prevent a crossing of the skis. These devices are furthermore supported nonmovably in the one direction and in the other direction swingably toward the other ski against a spring force. Should now, due to a lifting of the ski too high with respect to the other ski, a crossing still occur, then a return to the original position can practically take place easily, because during a sliding back of the one ski, the device is swung onto the other ski against the spring force.

Also ski brakes are known, which are constructed similarly and which have only downwardly projecting extensions. Such a ski brake is held against the spring force in condition of use approximately parallel with respect to the ski surface by the ski boot. During a release of the ski boot, for example during a fall, the ski brake opens to cause the two extensions to project downwardly over the ski side surfaces and thus hinder or brake the ski from travelling on.

These devices are very complicated and expensive in structure. Torsion springs, helical springs and also leaf springs are mostly used thereby, which, however, also need naturally a suitable amount of space and are also expensive to manufacture.

The purpose of the invention is now to avoid these disadvantages and to produce a construction which is simple, hardly susceptible to trouble and can be designed principally both as a prevention against a crossing of skis and also as a brake. This purpose is attained by the spring which conventionally consists of spring wire forming with a bent portion resting on the ski a resilient projection.

Through this, the principle of a torsion bar springing is used, which cannot be affected by outside influences, such as ice, snow, dirt and the like. Furthermore, a very inexpensive structure is obtained wherein also susceptibility to trouble is prevented or is reduced very considerably.

BRIEF DESCRIPTION OF THE DRAWINGS

The subject matter of the invention is illustrated exemplarily in several embodiments in the drawings, in which:

FIG. 1 is a top view of a pair of skis;

FIG. 2 is a sectional view taken along the line II—II of FIG. 3;

FIG. 3 is a top view of the structure illustrated in FIG. 2;

FIG. 4 is a sectional view taken along the line IV—IV of FIG. 5;

FIG. 5 is a top view of the structure illustrated in FIG. 4;

DETAILED DESCRIPTION

Figure 6:
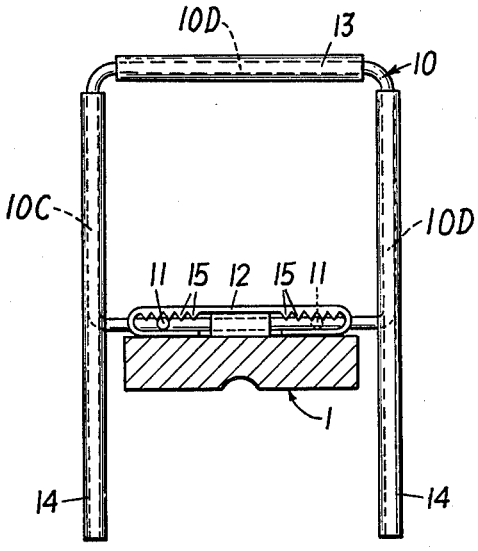
FIG. 6 is a sectional view taken along the line VI—VI in FIG. 7.

As can be recognized in FIG. 1, a device for preventing the crossing of skis 1 is arranged on each of the two skis 1 adjacent the tips thereof. Each of these devices consists substantially only of a rod 2 made of spring wire and projects upwardly from the upper surface of the ski 1. The rod 2 has bent ends 3 which are secured on the ski. If now, for example, a force occurs in the direction of the arrow 4, through which force the skis 1 would cross, then the one ski hits the rod 2 and thus a crossing is prevented.

However, if in spite of this, for example, the situation occurs wherein due to a lifting of one of the skis too high relative to the other ski, a crossing takes place, as this is indicated by the dash-dotted ski in FIG. 1, the ski can be returned without being lifted up again. That is, during a movement of the ski in the direction of the arrow 5, the dash-dotted illustrated ski will strike the rod 2 more from the side, so that same can swivel by overcoming the torsional spring force of the rod 2 secured on the ski 1.

The construction of the device for preventing the crossing of skis is illustrated in more structural detail in FIGS. 2 and 3. The rod 2 is U-shaped in construction having vertical legs 2A and 2B connected together at the top thereof by a horizontal leg 2C. The U-shaped construction is positioned practically upright on the ski 1. The bent ends 3 extend parallel to the longitudinal axis of the ski 1 and are held on the ski 1 by means of a fastening plate 6 secured to the ski by screws or the like. The legs 2D and 2E of the rod 2 are each connected to an end 3 and extend away therefrom perpendicular to the axis of the ski and in recesses in the plate 6. The left end of the leg 2D is connected to the lower end of the leg 2B and the right end of the leg 2E is connected to the lower end of the leg 2A. The illustrated device in FIGS. 2 and 3 is designated for the left ski. If now the right ski moves in direction of the arrow 4 against the rod 2, the ski is prevented from moving any further by the vertical leg 2A of the rod 2. The rod 2 or the vertical legs 2A and 2B of the rod 2 are substantially nonmovable in direction of the arrow 4. Should, as already mentioned, a crossing still take place for some reason, the right ski can be returned without requiring a lifting thereof; that is, it strikes during its movement in direction of the arrow 5 the rod 2B. The entire rod structure 2 can be swivelled or pivoted on the surface of the ski by overcoming the torsional force of the bent ends 3 which rest on the ski 1. The legs 2D and 2E form the swivel or pivot axes. If the two skis are again moved away from one another, the rod structure 2 stands up automatically again into the illustrated position due to the torsional spring return force.

FIGS. 4 and 5 illustrate a similar construction. A difference, however, exists in that the spring wire rod 2' consists only of two legs 7,8. Thus, viewed in the longitudinal direction of the ski (FIG. 4), a triangle is practically formed wherein the leg 8 extends substantially vertically upwardly or only at a small angle to a vertical plane. The leg 7A is secured to the lower end of the leg 7 and the leg 8A is secured to the lower end of the leg 8. The legs 7A and 8A extend in recesses provided in the bottom surface of a plate 9 secured to the ski by screws, for example. The leg 7, however, is constructed substantially more inclined, so that it forms practically an inclined ramp. If the second ski, in the present case the right ski, strikes the vertical leg 8, it forms substantially a rigid stop which prevents a crossing of the skis. Should, however, a crossing occur, for example due to the ski being lifted too high, here too a return can easily take place; that is, the second ski, thus the right ski, can slide upwardly on the rod leg 7 and can also effect a pivoting of the rod 2' about the axes of the legs 7A and 8A to move the legs 7 and 8 toward the upper ski surface, as this will generally be the case in the situation of higher stress on the ski.

The angle, at which the legs 7,8 or the leg 2C in FIG. 3 is oriented relative to the longitudinal axis of the ski can also be chosen substantially acuter which will permit an easier sliding back of the skis. However, in such a case, it would be advantageous if a stop were provided to prevent a rearward swinging of the legs. Such a stop can be simply provided by the bent portion which follows the vertical leg 2A of the rod 2 or the leg 8 not extending, as this is illustrated, in a straight line more or less transversely to the ski, but have, during the course of this extent, a further bent portion.

The use of the invention in a ski brake environment can be seen from the remaining FIGS. 6 to 13. According to FIGS. 6 and 7, again a spring wire rod 10 is provided which is held with its bent ends 11 on the ski 1 by means of a holding mechanism 12 secured to the ski 1 by screws, for example. The rod 10 has legs 10A and 10B which extend away from the ends 11 transversely of the axis of the ski 1 to vertical legs 10C and 10D. The upper ends of the legs 10C and 10D are connected by a horizontal leg 10E. A tube 13 is supported on the crossbar 10E of the rod 10, on which tube is mounted the ski boot in condition of use. Downwardly projecting braking mandrels 14 are secured to the vertical legs 10C and 10D of the rod 10, which braking mandrels 14 hinder the movement of the ski in the illustrated position, that is, when the ski has become separated from the ski boot. In the condition of use, the rod 10E is placed on the surface of the ski by the ski boot, so that the braking mandrels 14 extend parallel to the longitudinal axis of the ski. This construction has also the advantage that the rod structure 10 can be pivoted in both directions on the ski about the axes of the legs 10A and 10B and at any rate the same effect occurs. The bent ends 11 are held between ribs 15 on the holding mechanism 12. By releasing the holding mechanism 12, the bent ends 11 can be adjusted to various ski widths and are then held again between ribs 15 of the holding mechanism 12 in the required position.

Figure 8:
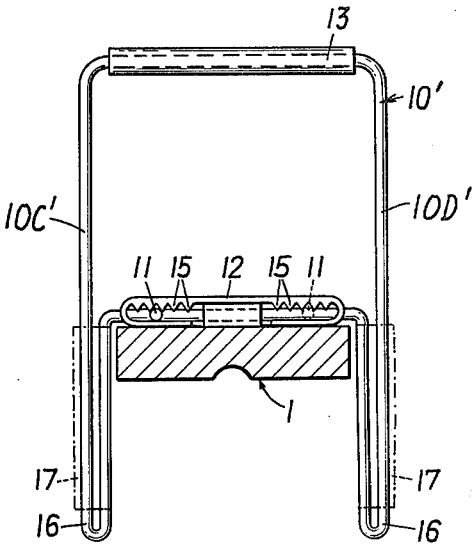
FIG. 8 is a sectional view taken along the line VIII—VIII of FIG. 9.
Figure 7:
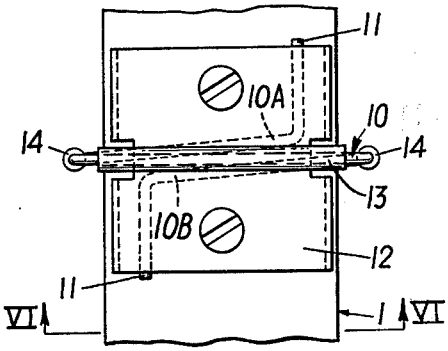
FIG. 7 is a top view of the structure illustrated in FIG. 6.
Figure 9:
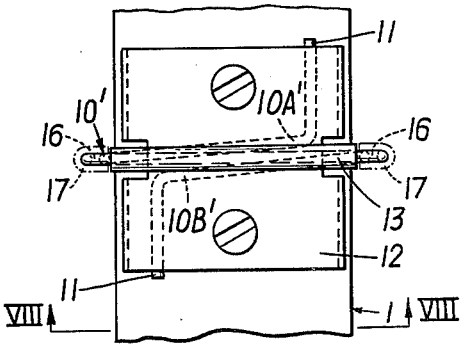
FIG. 9 is a top view of the structure illustrated in FIG. 8.

The rod construction 10', according to FIGS. 8 and 9, is very similar to the preceding construction of FIGS. 6 and 7. A difference, however, exists only in the vertical legs 10C' and 10D' of the rod 10' extending downwardly below the ski and being bent back at the lower end at 180° and extending to the legs 10A' and 10B' on the upper surface of the ski. These extensions and the bent-back parts form the braking mandrels 16, which are enveloped by a plate 17 or a plastic molding. For the remainder, the operation and structure is identical to the construction according to FIGS. 6 and 7.

Figure 10:
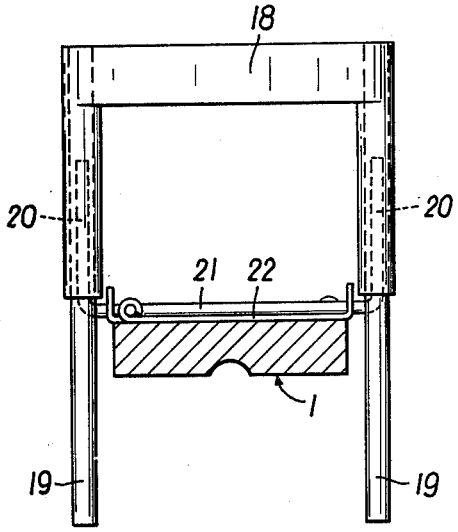
FIG. 10 is a sectional view taken along the line X—X of FIG. 11.
Figure 11:
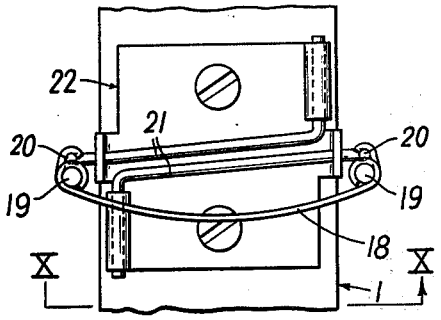
FIG. 11 is a top view of the structure illustrated in FIG. 10.

According to the construction in FIGS. 10 and 11, the rod and the spring force generating parts are separate from one another. The rod, in this embodiment, consists of a bent crossbar 18 which is shaped to surround both the downwardly projecting braking mandrels 19 and also the spring wire parts 20. The spring wire parts 20 have bent ends 21 which are held on the ski by a holding mechanism 22 secured to the ski by screws, for example. The spring wire parts urge the device in the shown braking position. During a stepping into of the binding, the ski boot will pivot the rod 18 and the braking mandrels 19 about the axes of the bent ends 21 on the ski surface. The bent rod 18 extends now in the lower area into a flat or straight extending position which causes the lower ends of the braking mandrels 19 to practically swing toward one another. They are thus, when the ski boot is held on the ski between the bindings, swung more inwardly.

Figure 12:
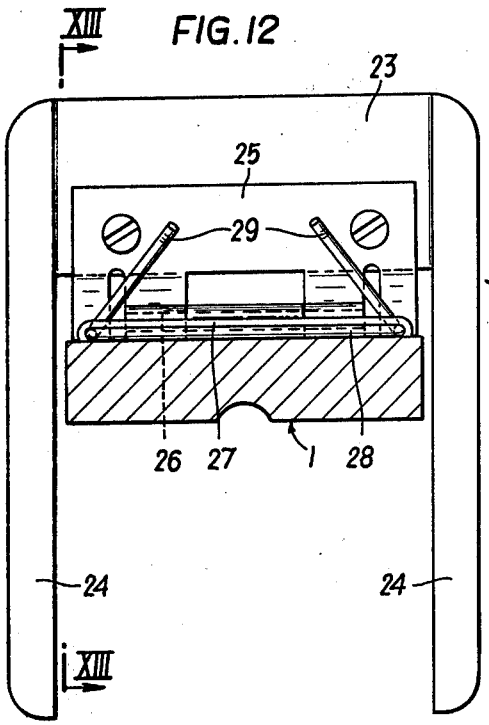
FIG. 12 is a sectional view taken along the line XII—XII of FIG. 13.
Figure 13:
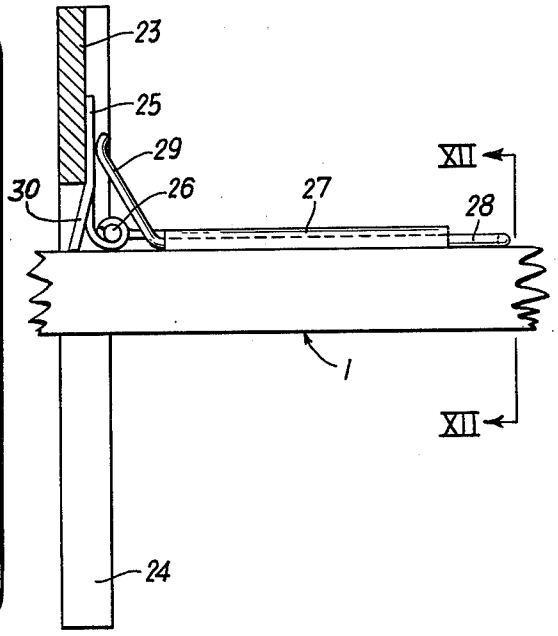
FIG. 13 is a sectional view taken along the line XIII—XIII of FIG. 12.

According to FIGS. 12 and 13, the ski brake has a plate 23 with braking mandrels 24, which is supported pivotally about the hinge axis 26 on the ski by means of a hinge plate 25. An approximately U-shaped (when viewed from the top of the ski) spring wire part 28 is secured on the ski 1 by means of a holding mechanism 27 secured by screws or the like. The holding mechanism 27 has journals which define the hinge axis 26. The spring wire part 28 has two angled sections 29, which engage the plate 23 projecting upwardly with respect to the surface of the ski 1 and inclined both in longitudinal and also in transverse direction. If the plate 23 is swung by the ski boot toward the ski 1 or toward the holding mechanism 27, the resilient angled sections 29 of the spring wire part 28 are swung toward the center of the ski. Through this, the perpendicular distance of the fulcrum from the line of action of the force at the point of engagement of the spring angled sections 29 changes in relationship to the hinge axis 26. That is, the effective lever arm is the smallest in the swung in condition, thus when the plate 23 lies parallel to the ski 1. Of course, in this case the force with which the plate must be held on the ski is naturally also relatively small. The effective force in the braking position, as same can be taken from the drawings, results in the largest force or the largest moment by which the plate 23 is held upright.

A stop 30 is provided on the hinge plate 25 to limit the pivotal movement of the plate 23 and the upper part of the braking mandels 24 beyond and to the left of the position illustrated in FIG. 13.

The invention is not limited to the exemplary embodiments. A number of possibilities of construction exist, which lie within the scope of the invention.

A further advantage of the invention consists also in particular in the device for preventing the crossing of the skis according to FIGS. 2 to 5 being designed wider than the ski, so that it is arranged at an angle with respect to the longitudinal axis of the ski, without projecting over the side surfaces of the ski. This practically also results in an adjustment to various ski widths.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An anti cross-over apparatus for skis comprising an upstanding bracket adapted to extend substantially transversely across its associated ski, means mounting the upstanding bracket for pivotable movement about a transverse axis into a position bearing substantially flatly against the top surface of the ski, said upstanding bracket comprising a resilient spring bracket member having two free ends, said two free ends extending transversely to the ski in substantially parallel relationship to one another, said free ends being spaced from each other in the longitudinal direction of the ski and serving as pivot shafts for the spring bracket member, said mounting means comprising a base body, said two free ends of the spring bracket being pivotably mounted in said base body, the spring bracket member and the pivotable mounting of the free ends thereof enabling said spring bracket member to resiliently tilt over in the longitudinal direction of said associated ski in the event cross-over of the skis has occurred and to return to its upstanding position after the skis have been uncrossed.

2. The apparatus as defined in claim 1, wherein said bracket, viewed in the lengthwise direction of its associated ski, possesses the shape of an unequal-sided triangle having two upstanding sides and a base, one of said sides being steeper with respect to the base than the other upstanding side, said one side adapted to be located at the inside of its associated ski, said upstanding sides extending in a plane forming an acute angle with a longitudinal axis of the associated ski.

* * * * *